US011826296B1

(12) United States Patent
Wilson et al.

(10) Patent No.: US 11,826,296 B1
(45) Date of Patent: Nov. 28, 2023

(54) HEAD SUPPORT FOR PATIENT INTUBATION

(71) Applicant: Turn Medical, LLC, San Antonio, TX (US)

(72) Inventors: Kevin S. Wilson, San Antonio, TX (US); Eric W. Barta, Castle Hills, TX (US); Christopher T. Niederkrom, San Antonio, TX (US)

(73) Assignee: Turn Medical, LLC, San Antonio, TX (US)

( * ) Notice: Subject to any disclaimer, the term of this patent is extended or adjusted under 35 U.S.C. 154(b) by 0 days.

(21) Appl. No.: 17/723,364

(22) Filed: Apr. 18, 2022

Related U.S. Application Data

(60) Provisional application No. 63/176,147, filed on Apr. 16, 2021, provisional application No. 63/176,150, filed on Apr. 16, 2021.

(51) Int. Cl.
*A61G 7/07* (2006.01)
*A61G 7/008* (2006.01)

(52) U.S. Cl.
CPC ..... *A61G 7/072* (2013.01); *A61G 7/008* (2013.01); *A61G 7/07* (2013.01)

(58) Field of Classification Search
CPC ..... A61G 7/072; A61G 7/07; A61G 7/008; A61G 7/002
USPC ..... 5/616, 613, 607
See application file for complete search history.

(56) References Cited

U.S. PATENT DOCUMENTS 5,184,365 A 2/1993 Stafford
5,502,853 A * 4/1996 Singleton ..... A61G 7/0507 5/430
6,282,736 B1 * 9/2001 Hand ..... A61H 31/006 5/607
6,499,160 B2 * 12/2002 Hand ..... A61G 7/008 5/607
6,691,347 B2 * 2/2004 Hand ..... A61B 6/0487 5/607
6,862,759 B2 3/2005 Hand et al.
7,077,141 B2 7/2006 Troop
7,127,758 B2 10/2006 Gabbay
7,189,214 B1 * 3/2007 Saunders ..... A61H 1/0292 5/618
7,213,596 B2 5/2007 Saied
7,716,763 B2 5/2010 Nissen et al.
(Continued)

FOREIGN PATENT DOCUMENTS

WO WO-9907320 A2 * 2/1999 ..... A61B 6/0428
WO WO-2016048477 A1 * 3/2016 ..... A61G 13/0036

*Primary Examiner* — Robert G Santos
(74) *Attorney, Agent, or Firm* — Pizarro Allen P.C.

(57) ABSTRACT

Support assemblies for supporting the head of a patient during rotation are described. A head support can be tilted so as to orient a patient for intubation. For example, the head support may include a tilt frame that is configured to position a patient's airway automatically and efficiently to an orientation suitable for patient airway intubation. In some embodiments, a tilt frame may allow for automatic positioning of a patient's airway to a predetermined orientation generally deemed suitable for patient airway intubation and allow for easy adjustment of the angle of the tilt frame so as to particularly orient an individual patient's airway as needed for a medical procedure.

15 Claims, 7 Drawing Sheets

(56) References Cited

U.S. PATENT DOCUMENTS 8,171,582 B1 * 5/2012 Nikolaev ..... A61G 7/012 5/915
10,543,142 B2 * 1/2020 Lim ..... A61G 7/015
10,576,006 B2 * 3/2020 Lim ..... A61G 13/1235
10,722,413 B2 * 7/2020 Lim ..... A61G 13/08
10,835,063 B2 * 11/2020 Bourgeois ..... A47G 9/1009
10,835,439 B2 * 11/2020 Lim ..... A61G 13/08
10,849,809 B2 * 12/2020 Lim ..... A61G 13/04
10,874,570 B2 * 12/2020 Lim ..... A61G 7/1019
10,881,570 B2 * 1/2021 Lim ..... A61G 13/04
10,888,183 B2 1/2021 Popitz et al.
10,888,484 B2 * 1/2021 Lim ..... A61G 13/0036
10,893,996 B2 * 1/2021 Lim ..... A61B 34/30
10,898,401 B2 * 1/2021 Lim ..... A61G 13/08
10,900,448 B2 * 1/2021 Lim ..... A61G 13/04
10,966,892 B2 * 4/2021 Lim ..... A61G 13/06
11,020,304 B2 * 6/2021 Lim ..... A61G 13/08
11,052,008 B2 * 7/2021 Lim ..... A61G 13/08
11,234,886 B2 * 2/2022 Lim ..... A61G 13/0036
11,304,867 B2 * 4/2022 Lim ..... A61G 7/1019
11,369,538 B2 * 6/2022 Lim ..... A61G 13/121
11,389,362 B2 * 7/2022 Lim ..... A61G 13/121
11,612,533 B2 * 3/2023 Lim ..... A61G 13/08 5/607
11,696,863 B2 * 7/2023 Lim ..... A61G 13/08 5/613
2002/0026671 A1 * 3/2002 Hand ..... A61G 7/008 5/608
2003/0115673 A1 * 6/2003 Hand ..... A61B 6/0487 5/608
2004/0226091 A1 11/2004 Hand et al.
2012/0117729 A1 * 5/2012 Nikolaev ..... A61G 7/005 5/604
2017/0049651 A1 * 2/2017 Lim ..... A61G 13/1235
2017/0246066 A1 * 8/2017 Reilly ..... A61G 13/0036
2018/0363596 A1 * 12/2018 Lim ..... A61G 13/08
2018/0368593 A1 * 12/2018 Bourgeois ..... A47G 9/1081
2019/0000702 A1 * 1/2019 Lim ..... A61G 7/1019
2019/0000707 A1 * 1/2019 Lim ..... A61G 13/122
2019/0046381 A1 * 2/2019 Lim ..... A61G 7/015
2019/0046383 A1 * 2/2019 Lim ..... A61G 13/121
2020/0060913 A1 * 2/2020 Lim ..... A61B 34/30
2020/0060914 A1 * 2/2020 Lim ..... A61B 34/30
2020/0060915 A1 * 2/2020 Lim ..... A61G 13/08
2020/0138659 A1 * 5/2020 Lim ..... A61G 7/015
2020/0188208 A1 * 6/2020 Lim ..... A61G 13/1235
2020/0281788 A1 * 9/2020 Lim ..... A61G 13/08
2020/0297568 A1 * 9/2020 Lim ..... A61G 7/015
2020/0337926 A1 * 10/2020 Lim ..... A61G 13/1285
2020/0337927 A1 * 10/2020 Lim ..... A61G 13/04
2020/0360214 A1 * 11/2020 Lim ..... A61G 7/008
2021/0069047 A1 * 3/2021 Lim ..... A61G 13/125
2021/0085548 A1 * 3/2021 Lim ..... A61G 13/1245
2021/0085549 A1 * 3/2021 Lim ..... A61G 13/1285
2021/0330536 A1 * 10/2021 Lim ..... A61G 13/122

* cited by examiner

HEAD SUPPORT FOR PATIENT INTUBATION

CROSS-REFERENCE TO RELATED APPLICATIONS

This application claims priority to U.S. Provisional Patent Application No. 63/176,147 titled "Head Support Assemblies and Use with Intubated Patients" filed Apr. 16, 2021. This application also claims priority to U.S. Provisional Patent Application No. 63/176,150 titled "Head Support Assemblies with an Adjustable Posterior Head Support and Related Therapeutic Uses" filed Apr. 16, 2021. The full disclosure of each of the aforementioned patent applications is herein fully incorporated by reference.

FIELD

This invention relates to patient head support for prone therapy.

BACKGROUND

Patients with extreme pulmonary issues, such as acute respiratory syndrome (ARDS), often require intubation (placement of a tube into the patient's airway) in order to provide oxygen. A common treatment for issues such as ARDS is to place the patient in the prone position. When a patient is placed in the prone position it is typically necessary to fully support all sides of the patient's body, as well as the patients head with support packs or pads. These support packs must be moved in order to gain access to the patient for specific procedures. One of the more time-critical patient care activities is reintubation, upon accidental extubation. In order to reintubate a patient it is necessary to tilt the patients head back relative to the body. This is often done using pillows to elevate the shoulders of the patient. If a patient is confined by support packs, it becomes necessary to remove the appropriate support packs in order to gain access to the patient's torso for positioning prior to intubation.

There is a need for improved support assemblies which can be easily moved to a tilted position so that the patient's head can be tilted back to the appropriate position for intubation.

SUMMARY

In some embodiments, a therapeutic bed may include a frame configured for rotation of a patient and a chassis coupled to the frame. The therapeutic bed may further include a tilt frame having a first end pivotably coupled to the chassis and a second end, the tilt frame configured to constrain movement of the head of the patient when the tilt frame is rotated about the first end with respect to the chassis.

In some embodiments, a therapeutic bed may include a frame configured to rotate a patient between a supine position and a prone position, the frame comprising a body portion and a head portion, the head portion being pivotably coupled to the body portion so as to permit rotation of the head portion out of the plane of the frame.

In some embodiments, a method of adjusting a therapeutic bed for patient intubation may include rotating a frame of a therapeutic bed to a prone position. The therapeutic bed includes a frame configured to rotate the patient between a supine position and a prone position; a chassis coupled to the frame; and a tilt frame having a first end pivotably coupled to the chassis and a second end, the tilt frame configured to support the head of the patient when and the tilt frame is rotated about the first end with respect to the chassis. The method may further include releasing the second end of the tilt frame from the chassis; and pivoting the tilt frame to an angle suitable for intubating the patient.

DETAILED DESCRIPTION

This disclosure is directed to head support for therapeutic beds configured for prone therapy. To provide context for describing the structure and function of various embodiments of head support for patient intubation, the disclosure turns first to an overview of an embodiment of a therapeutic bed in which head support for patient intubation may be suitably provided.

Therapeutic Bed

Figure 1:
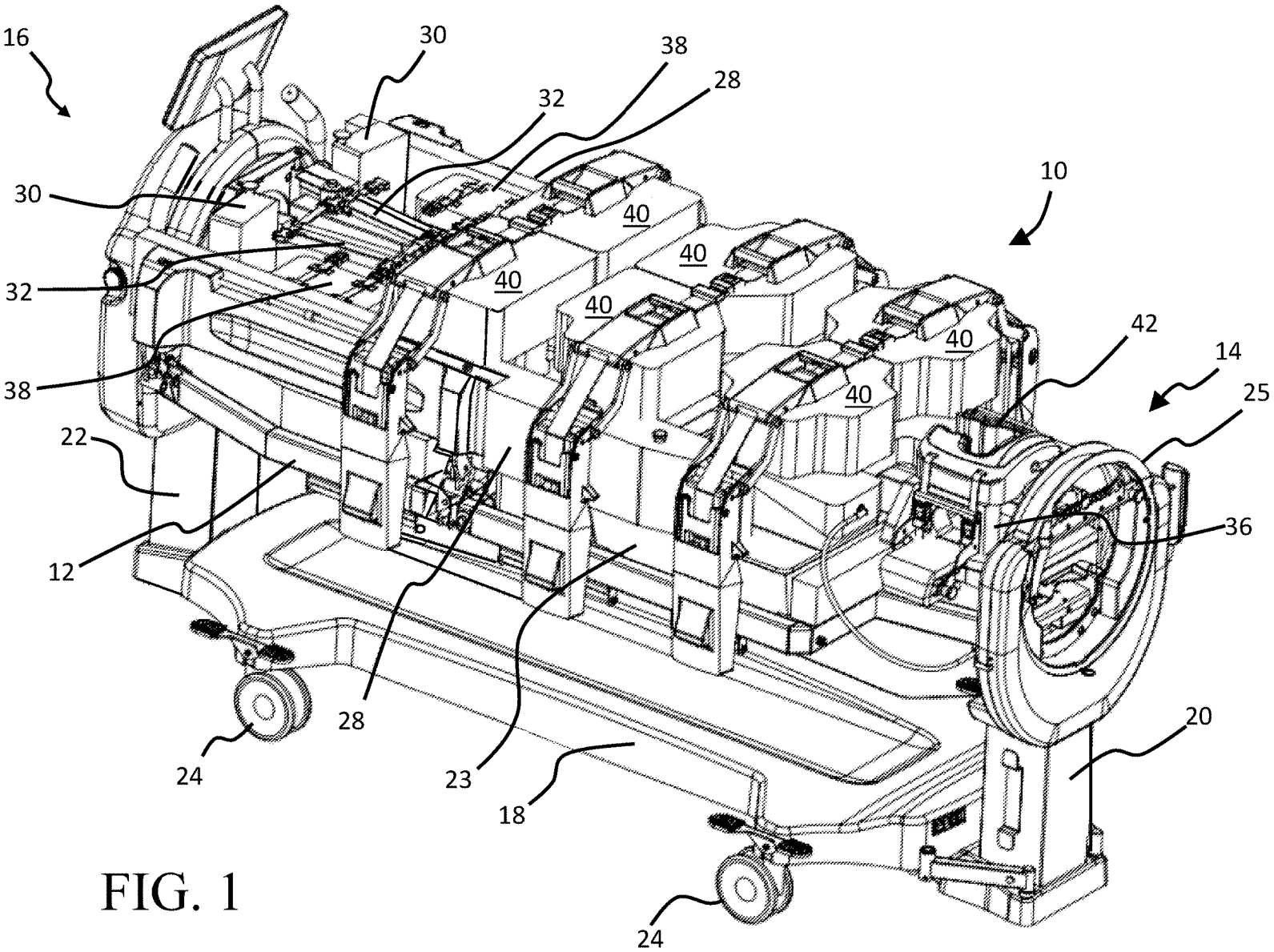
FIG. 1 illustrates an embodiment of a therapeutic bed configured for prone therapy.

FIG. 1 illustrates an embodiment of a therapeutic bed 10 configured to support a patient (not shown) for prone therapy and/or kinetic therapy. Therapeutic bed includes a patient support frame 12 having a head end 14 and a foot end 16. The patient support frame is coupled to a caster frame 18 by a first lift column 20 at the head end and by a second lift column 22 at the foot end. The caster frame may be supported by a plurality of casters 24 for bed mobility.

The therapeutic bed embodiment of FIG. 1 may move a patient through primarily two therapeutic modes of movement: a rotational mode and a tilt mode. To provide a rotational mode of movement, the patient support frame may be rotated about a long axis extending through the foot end and the head end of the patient support frame. The rotational mode of movement permits a patient to be rotated from a supine (face up) orientation to a prone (face down) orientation. The rotational mode of movement may further permit a patient to be oscillated through a range of angular positions in either or both of the supine or prone orientations. The rotational mode of movement may further permit 360° rotation, or rotation through more or less than 360°.

To permit rotational movement, the patient support frame may be rotatably coupled to the lift columns. For example, the foot end of the patient support frame may be coupled to lift column 22 by any suitable means, such as through a plate or saddle (not shown). Other suitable means for providing rotatable coupling between the lift column 22 and patient support frame may be used, such as those described in U.S. Pat. No. 6,862,759, for example, which is herein incorporated by reference. The head end of the patient support frame may comprise a hoop 25, which may be coupled to a lift column 20 using any suitable means. For example, the patient support frame may rest on a roller support coupled to a saddle (not shown) with the saddle coupled to the lift column 20. A drive system (not shown), such as an electrical motor and drive belt, and electronic controls may be used to selectively rotate the patient support frame. Of course, other suitable means for rotatably coupling the patient support frame and lift column 20 may be used. In some modes of operation, the patient support frame may be manually rotated.

To provide a tilt mode of movement, the length of each lift column may be independently adjusted so as to raise and lower the head end of the patient support frame independently of the foot end, or to raise and lower the foot end of the patient support frame independently of the head end. Furthermore, the length of each lift column may be adjusted so as to raise or lower the entire patient support frame with respect to the caster frame. That is, the distance between either or both end of the patient support frame and the caster frame may be adjusted. To permit tilt movement, lift column height may be adjusted by any suitable mechanism, such as by hydraulics, screw, gas spring, coil spring, ratchet or removable pin.

Patient Constraint

When the patient support frame is oriented to support a patient in a supine position, the patient may rest on one or more patient support pads 23 disposed on the patient support frame 12. The one or more support pads 23 may provide a patient support surface to support the patient. However, when the patient support frame 12 is moved through one or more modes of movement, the patient must be constrained from sliding or falling from the patient support frame. A variety of packs may be provided to constrain a patient during bed movement.

A plurality of lateral packs may constrain the patient's legs, torso, arms and head from lateral movement with respect to the patient support surface. Such lateral packs may include, for example, side support packs 28, foot packs 30, abductor packs 32, and head packs 36.

A plurality of prone packs may prevent a patient from falling from the bed when the patient is rotated to a prone position. Such prone packs may include, for example, leg packs 38, torso or thigh packs 40 and a face pack 42.

The term "pack" as used herein refers to a structure that is firm enough to substantially maintain its shape while supporting the patient's body but is also soft so as to comfortably support the patient's body. A pack may, for example, be comprised of a rigid support panel or other structure surrounded by a padding. A pack may be comprised of one or more layers. A pack may comprise a single type of padding. Alternatively, a pack may comprise several different padding materials such as may be used such as to provide a desired level of support in different parts of a pack. For example, a pack may be comprised of materials with more than one spring rate or initial force deflection rating so as to control a level of immersion of the pack around the patient's body. A pack may be shaped to receive a part of the patient's body. For example, a support pack may be generally shaped to contour a patient's legs, forehead, cheeks, or other body part against which it is designed to be disposed. In some embodiments, a pack may be shaped and/or made of materials with controlled properties (e.g., initial force deflection, spring rate, and other properties) so as to reduce any shearing stresses that tend to be formed on the patient's skin when a patient's body is immersed in the pack. A pack may, for example, be filled with a pressurized gas (such as air), foam, a gel, a viscous fluid, or another suitable material.

Patient Access

When the patient support frame is rotated to orient a patient in the prone position, a caregiver may require access to the patient through the patient support frame. The patient support frame may be provided with panels that a caregiver may open to allow access to the patient's body. Access may further be provided for intubation of the patient, as further described herein.

In view of the foregoing context, a more detailed description of a prone head support configured for patient intubation may now be provided. However, the foregoing embodiments of a therapeutic beds and various features and functions thereof should not be interpreted as limiting. Any prone head support configured for patient intubation as described herein may be used with any therapeutic bed in which a patient may be positioned or placed in a prone or face down position or in which a patient may be treated with rotation therapy.

Figure 2:
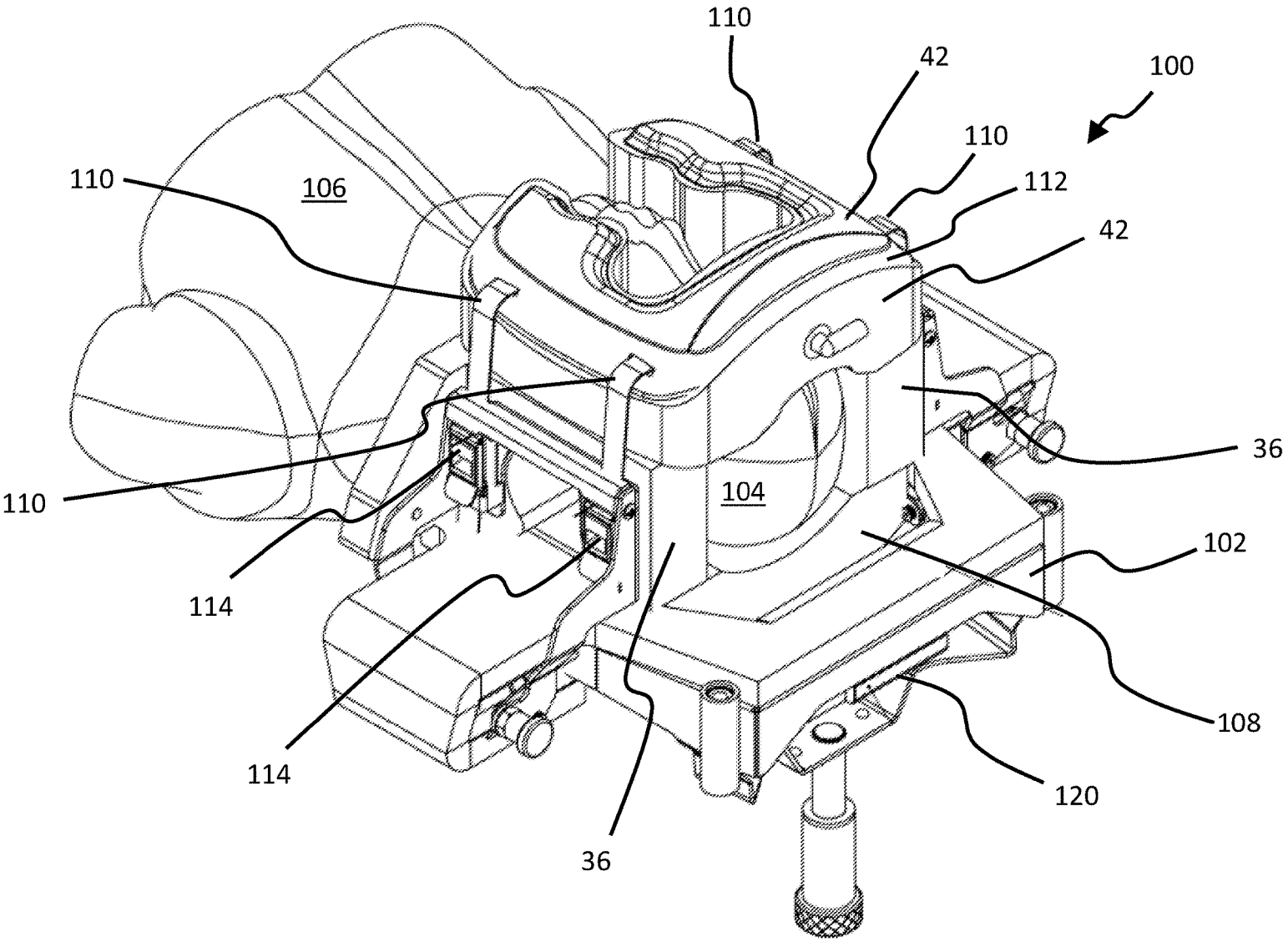
FIG. 2 illustrates an embodiment of a head support assembly shown with a patient in a supine or face up position.

As may be seen in the embodiment of FIG. 2, a face pack 42 may be provided as part of a head pack support assembly 100. The head pack support assembly 100 may comprise a chassis 102 configured to releasably constrain the head 104 of a patient 106. The chassis 102 may support a face pack 42, one or more lateral head packs 36, and a posterior head pack 108. The face pack 42 may be releasably coupled to the chassis 102 by a shroud 112 retained by a plurality of straps 110 adjustably held by buckles 114. As discussed in more detail below, a latch 120 may be operated to free a tilt frame 122 of the chassis 102 for better positioning a patient head for intubation.

Figure 3:
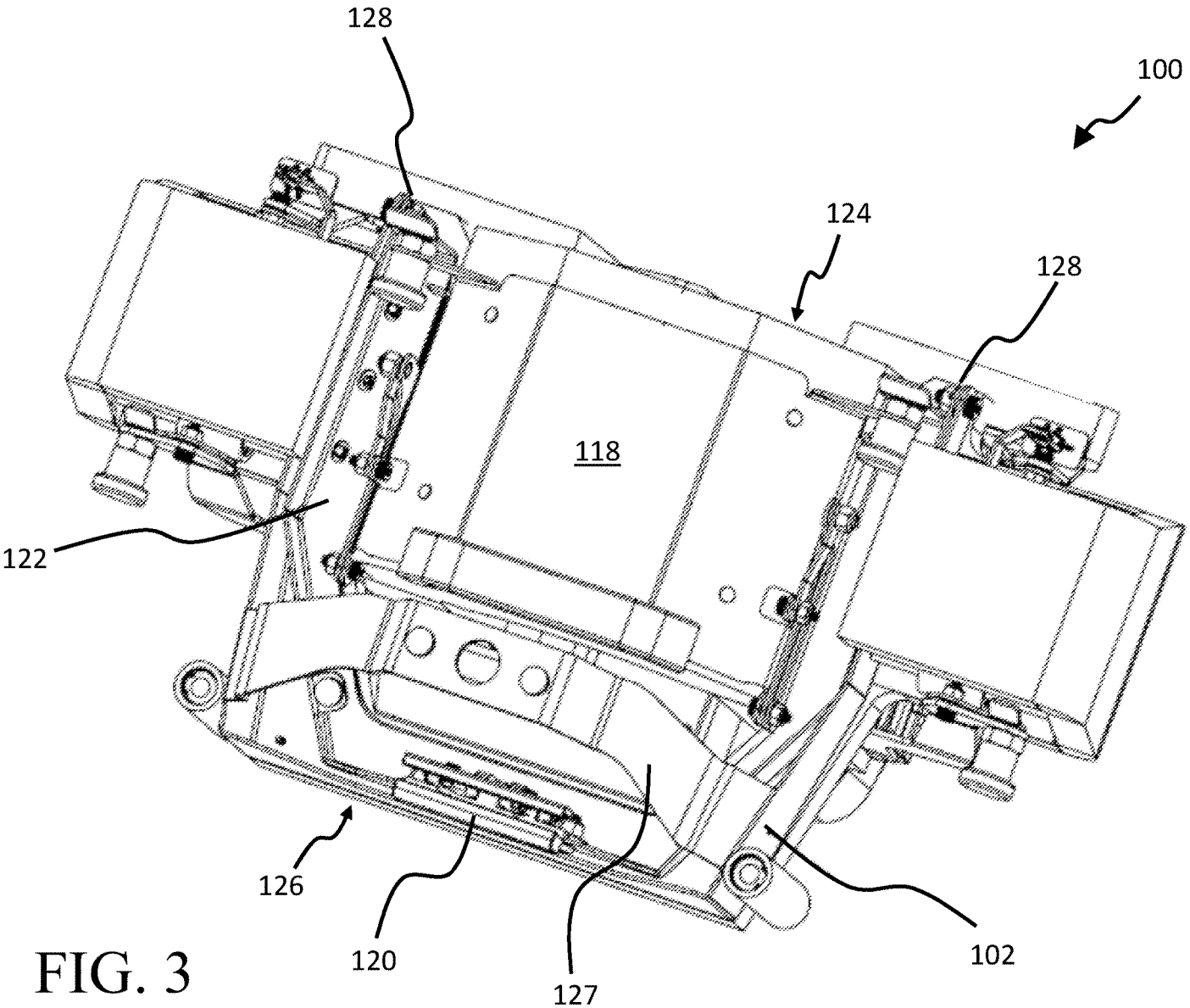
FIG. 3 illustrates the head support assembly of FIG. 2 shown in a prone or face down position.

Rotation of the patient support frame 12 to a prone position will result in orientation of the head pack support assembly 100, as may be seen in the embodiment of FIG. 3, so as to place the patient in a face-down position. The chassis 102 includes a tilt frame 122 having a first end 124 pivotably coupled to the chassis at pivots 128, and having a second end 126 releasably secured to the chassis by the latch. Pivotal coupling between the tilt panel and chassis may be provided by any suitable mechanism, such as a rod and sleeve, ball and socket, roller, U-joint or hinge.

Figure 4:
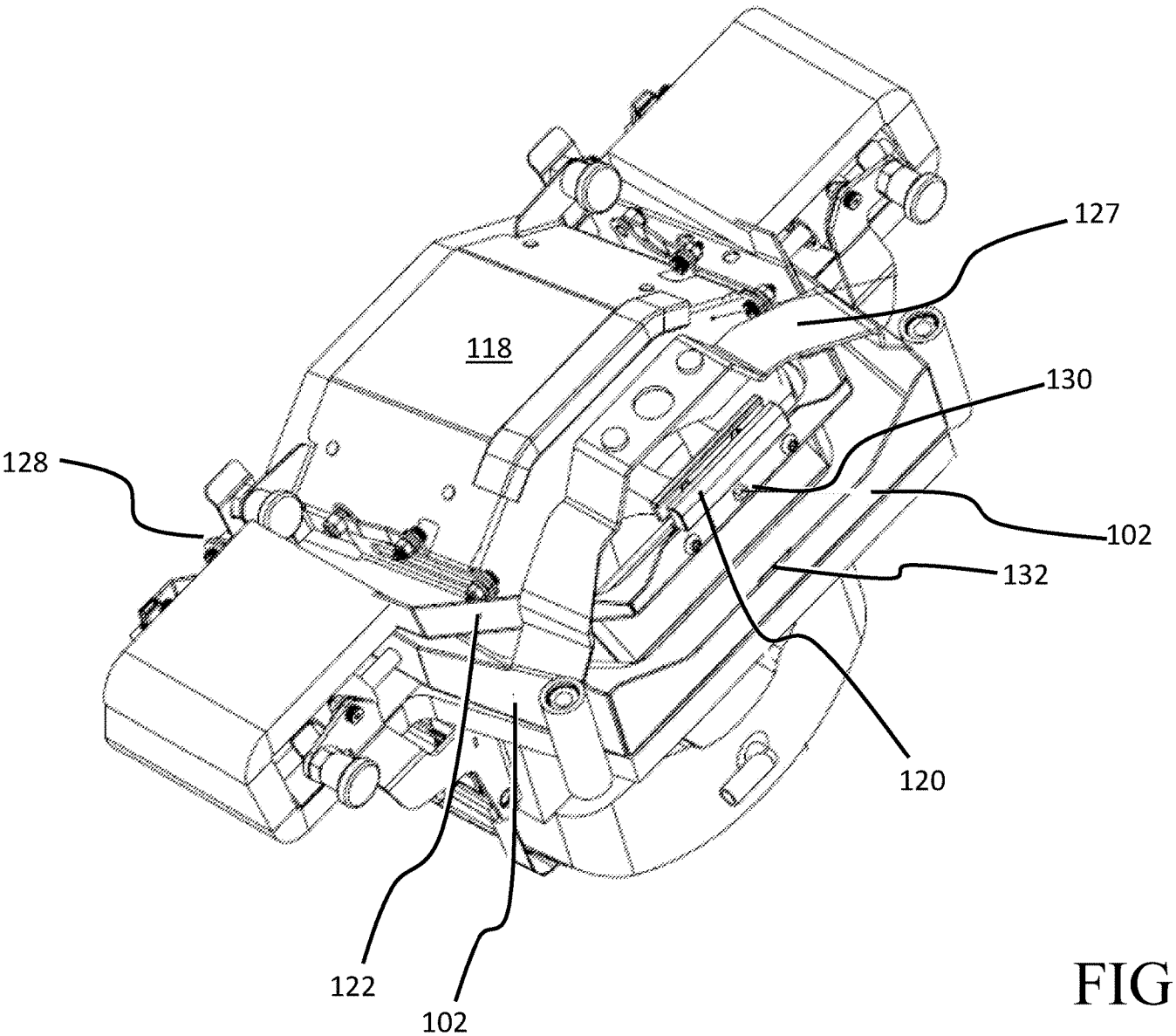
FIG. 4 illustrates another view of the head support assembly of FIG. 2 shown in a prone or face down position.

As may be seen in FIG. 4, the latch 120 may comprise a pin 130 cooperatively engaging an aperture (not shown) in the chassis 102. The aperture may be provided in a tab 132 mounted in the chassis 102. It will be appreciated that the second end of the tilt frame 122 may alternatively be secured to the chassis 102 by any suitable mechanism, such as ball and detent, magnets, frictional engagement between tilt frame and chassis, catch, one or more straps, and the like.

Releasing the latch 120 will retract the pin 130 from the receiving aperture, thus freeing the second end 126 of the tilt frame 122 to rotate about the pivots out of the plane of the chassis 102. A bracket 127 may be used to limit travel of the free second end 126 of the tilt frame 122. In some embodiments, the bracket 127 will limit travel of the free second end 126 of the tilt frame 122 to about 15° from the plane of the chassis.

Figure 5:
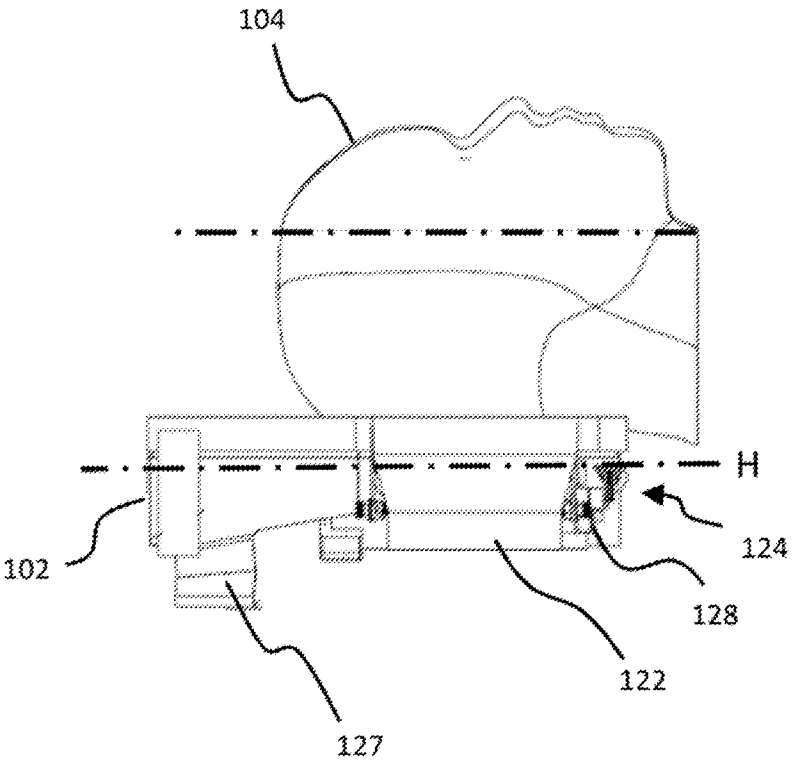
FIG. 5 shows the head support pack assembly of FIG. 2 with a closed tilt panel.

As may be seen in FIG. 5, when the patient support frame 12 is oriented to place the patient in a supine or face up position, the tilt frame 122 will lie in an approximately horizontal plane (H) generally aligned with the chassis 102.

Figure 6:
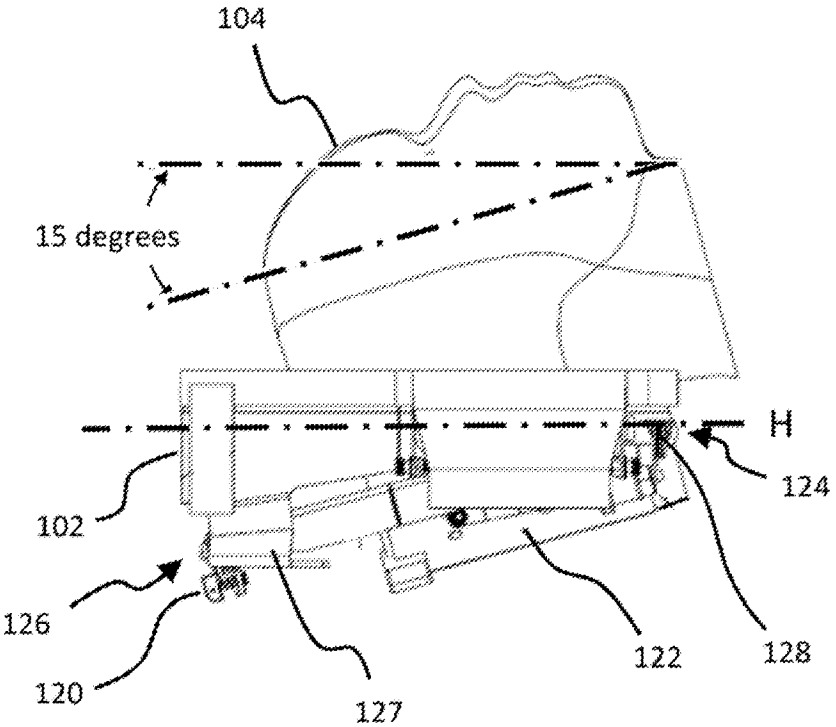
FIG. 6 shows the head support pack assembly of FIG. 2 with a tilt panel tilted down to provide patient intubation access.

When the latch 120 is released, the tilt frame 122 may be rotated below the horizontal plane (H), as may be seen in FIG. 6. As may be seen in FIGS. 5 and 6, the patient may be positioned on the patient support frame 12 and head pack support assembly 100 such that the patient neck is positioned at or near the tilt frame pivots 128. With the tilt frame 122 still supporting the patient's head, the patient's head 104 may thus be tilted relative to its initial position as the tilt frame 122 rotates out of the plane of the chassis 102. In some embodiments, the patient's head 104 may thus be tilted to approximately 15 degrees below horizontal, which is the optimal position to open the airway for placement of airway lines. Thus, the head pack support assembly 100 may be readily adjusted so as to quickly orient a patient head for intubation. When the tilt frame 122 is rotated back to the initial support position (horizontal, as shown in FIG. 5), the pin 130 will engage the receiving aperture, thereby holding the patients head 104 securely in position to proceed with prone therapy or other rotational therapies.

The tilt frame 122 has a posterior head pack 108 disposed thereon to support the back of the patient's head 104. In the embodiment of FIGS. 2 and 3, the tilt frame 122 includes posterior panel 118 on which the posterior head pack 108 may be disposed. Operation of the posterior panel is described in U.S. application Ser. No. 17/723,349 titled "Adjustable Posterior Head Support," filed Apr. 18, 2022, which is herein incorporated by reference. In other embodiments, the tilt frame 122 need not include a posterior panel 118 or any panels or doors for accessing the posterior of a patient head.

Figure 8:
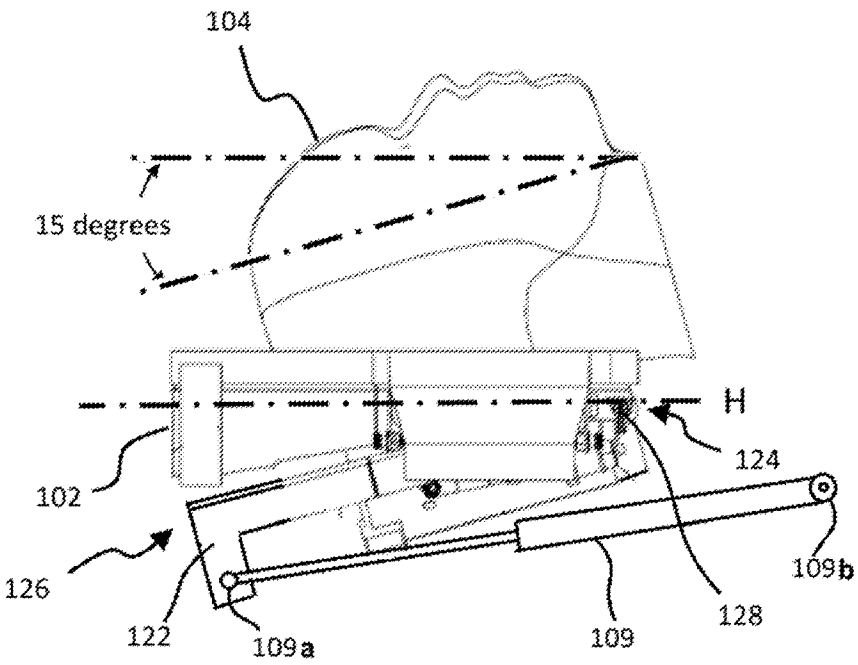
FIG. 8 is a schematic diagram of a head support pack assembly including a lockable gas spring so as to allow for variable tilt adjustment of a tilt frame.
Figure 7:
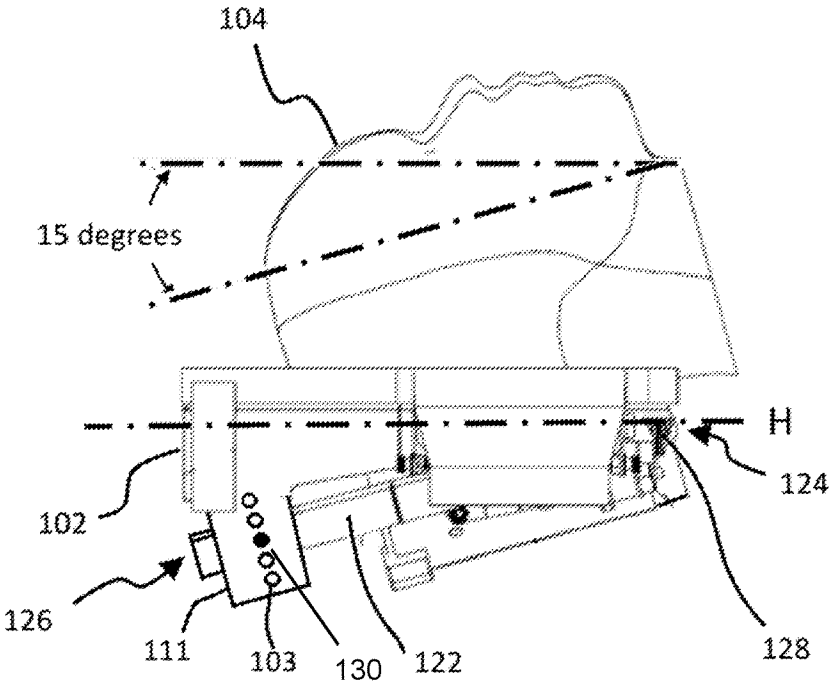
FIG. 7 is a schematic diagram of a head support pack assembly including a guiderail so as to allow for variable tilt adjustment of a tilt frame.
Figure 9:
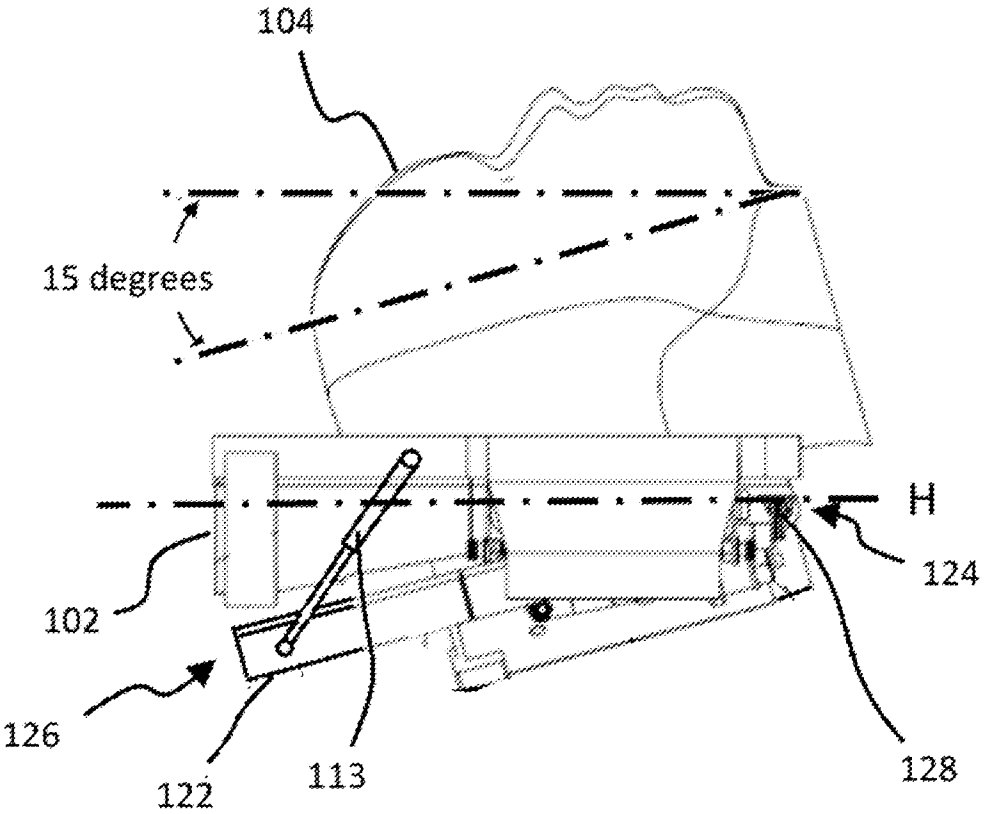
FIG. 9 is a schematic diagram of a head support pack assembly including a gas spring so as to allow for variable tilt adjustment of a tilt frame.

In some embodiments, the pin 130 may be received in any of a number of different receiving apertures. For example, pin 130 may be part of a guide rail so that the pin 130 may slide across and selectively engage different receiving apertures so as to allow positioning at different angular positions. For example, in the embodiment shown in FIG. 7, a pin 130 may be retained within one or more apertures 103 on the guiderail 111. In some embodiments, as shown in FIG. 8, a lockable gas spring 109 could be used to hold the tilt frame in an open, closed or any intermediate position so as to provide for substantially continuous adjustment of angle over a suitable range of angles. An actuator or lockable gas spring may have a first end 109*a* pivotably coupled to the tilt frame and have a second end 109*b* pivotably coupled to the frame (not shown) or chassis at such an orientation that extension and retraction of the gas spring rotates the tilt frame with respect to the chassis. In other embodiments, such as shown in FIG. 9, a gas spring 113 may be positioned, for example, between the tilt frame 122 and chassis 102 so as to reduce a chance of inadvertent jarring of a patient's neck when the tilt frame is rotated with respect to the chassis. The gas spring may or may not be lockable, and may be disposed on the tilt frame so that maximum extension of the gas spring permits rotation of the tilt frame to a suitable angle for airway intubation. In some embodiments, any combination of the aforementioned positioning strategies may be used. For example, initial release of a tilt frame may automatically position the tilt frame to an orientation generally deemed suitable for patient intubation. However, further adjustments to the position of the tilt frame position may then be made either by control of tilt angle using a gas spring or by manually positioning the tilt frame so that it locks at a desired position using a guiderail.

In some embodiments, a caregiver may hold the latch after releasing the pin and manually guide the assembly to a desired angular position. In some embodiments, the position of the tilt frame may be adjusted by other means. For example, in some embodiments, a powered actuator may be used to adjust the position of the tilt frame. In other embodiments, an air bladder could be used to support and move the tilt frame.

Although the action of the tilt frame is described above, in other embodiments the chassis of the head pack support assembly may be pivotably coupled to the patient support frame adjusting the angle of a patient's head to facilitate patient intubation or for other purposes. In embodiments in which the chassis rotates with respect to the frame, a tilt frame need not be used. The chassis may be tilted below the plane of the patient support frame for patient intubation.

It is an objective of some embodiments herein to provide a support system for securing a patient when the patient is suspended in a prone position or otherwise being rotated over some angular range. It is a further objective of some embodiments to provide for repositioning of the patient head to an appropriate position for intubation when the patient is in a supine position.

Although the foregoing specific details describe various embodiments, persons of ordinary skill in the art will recognize that various changes may be made in the details of the disclosed subject matter without departing from the spirit and scope of the invention as defined in the appended claims and other claims that may be drawn to this invention and considering the doctrine of equivalents. Among other things, any feature described for one embodiment may be used in any other embodiment, and any feature described herein may be used independently or in combination with other features. Also, unless the context indicates otherwise, it should be understood that when a component is described herein as being mounted or connected to another component, such mounting or connection may be direct with no intermediate components or indirect with one or more intermediate components. Therefore, it should be understood that the disclosed subject matter is not to be limited to the specific details shown and described herein.

What is claimed is:

1. A therapeutic bed comprising:

a patient support frame configured to underlie and support a patient in a substantially horizontal position, the patient support frame being configured for rotation;

a chassis coupled to the patient support frame;

a tilt frame having a first end pivotably coupled to the chassis and a second end, the tilt frame configured to support the head of the patient when the tilt frame is pivoted about the first end with respect to the chassis, the chassis configured to remain stationary relative to the patient support frame when the tilt frame is pivoted about the first end.

2. The therapeutic bed of claim 1, wherein pivoting of said tilt frame is configured to orient the tilt frame to an angle of about 15 degrees relative to a plane of said chassis.

3. The therapeutic bed of claim 1 further comprising a spring coupled between the tilt frame and either of the chassis or patient support frame.

4. The therapeutic bed of claim 3, said spring being a lockable gas spring configured to allow for substantially continuous adjustment of an angle of the tilt frame, relative to the plane of said chassis over a range of angles suitable for airway intubation of the patient.

5. The therapeutic bed of claim 1 further comprising a bracket mounted to the chassis so as to limit travel of the second end of the tilt frame when released from the chassis.

6. The therapeutic bed of claim 5 wherein said bracket is mounted so as to limit travel of the tilt frame to a predetermined angle that orients the patient's head to an orientation suitable for airway intubation.

7. A therapeutic bed for a patient comprising:

a patient support frame configured for rotation;

a chassis coupled to the patient support frame;

a tilt frame having a first end pivotably coupled to the chassis and a second end, the tilt frame configured to support the head of a patient when the tilt frame is pivoted about the first end with respect to the chassis;

wherein said first end of the tilt frame is configured for alignment with the patient's neck when the patient is positioned in the bed and the tilt frame is pivoted about the first end;

wherein pivoting of the tilt frame with respect to the chassis is configured to orient the patient's head to an orientation suitable for airway intubation of the patient.

8. The therapeutic bed of claim 7 further comprising a spring coupled between the tilt frame and either of the chassis or patience support frame.

9. The therapeutic bed of claim 8, said spring being a lockable gas spring configured to allow for substantially continuous adjustment of an angle of the tilt frame relative to the plane of said chassis over a range of angles suitable for airway intubation of the patient.

10. A therapeutic bed comprising:

a frame configured for rotation;

a chassis coupled to the frame;

a tilt frame having a first end pivotably coupled to the chassis and a second end, the tilt frame configured to support the head of a patient when the tilt frame is pivoted about the first end with respect to the chassis;

a latch releasably securing the second end to the chassis.

11. The therapeutic bed of claim 10, the latch including a pin configured to cooperatively engage with a first aperture of the chassis when the latch is secured to the chassis.

12. The therapeutic bed of claim 11 further comprising a guide rail including a plurality of apertures, the pin being configured to be received by different apertures among the plurality of apertures so as to allow the tilt frame to be adjusted to different angular positions with respect to a plane of the chassis.

13. A method of adjusting a therapeutic bed for patient intubation, the method comprising:

positioning a patient on a therapeutic bed, the therapeutic bed comprising:

a patient support frame configured to underlie and support the patient in a substantially horizontal position, the patient support frame being configured for rotation;

a chassis coupled to the patient support frame; and a tilt frame having a first end pivotably coupled to the chassis and a second end, the tilt frame configured to support the head of the patient when the tilt frame is pivoted about the first end with respect to the chassis, the chassis configured to remain stationary relative to the patient support frame when the tilt frame is pivoted about the first end; and pivoting the tilt frame about the first end to an angle suitable for intubating the patient.

14. The method of claim 13, the tilt frame further having the second end releasably secured to the chassis or the frame, wherein releasing the second end of the tilt frame comprises unlocking of a gas spring.

15. The method of claim 13, the tilt frame further having the second end releasably secured to the chassis, wherein releasing the second end of the tilt frame from the chassis comprises releasing a latch securing the second end of the tilt frame to the chassis.

* * * * *